United States Patent [19]

Ernisse et al.

[11] Patent Number: 4,466,420

[45] Date of Patent: Aug. 21, 1984

[54] MODULAR MASONRY HEATING SYSTEM

[76] Inventors: Hugh W. Ernisse; Perri A. Ernisse, both of Box 2146, Littleton, Mass. 01460

[21] Appl. No.: 348,471

[22] Filed: Feb. 12, 1982

[51] Int. Cl.[3] ..... F24C 1/16; F24C 1/00

[52] U.S. Cl. ..... 126/120; 126/9 B; 126/58; 126/131; 126/151; 126/114

[58] Field of Search ..... 126/120, 130, 131, 99 R, 126/99 D, 117, 144, 146, 151, 147, 74, 76, 77, 79, 75, 114

[56] References Cited

U.S. PATENT DOCUMENTS

| | | | |
|---|---|---|---|
| 13,525 | 9/1855 | Deeds . | |
| 21,900 | 10/1858 | Pearson . | |
| 70,679 | 11/1867 | Arthurs . | |
| 76,136 | 3/1868 | Amory . | |
| 90,095 | 5/1869 | Gwynn . | |
| 137,800 | 4/1873 | Sayre . | |
| 145,512 | 12/1873 | Magee . | |
| 212,106 | 2/1879 | Muchmore . | |
| 369,100 | 8/1887 | Culver | 126/75 |
| 394,293 | 12/1888 | Perrott . | |
| 446,008 | 2/1891 | Peteler . | |
| 522,364 | 7/1894 | Finley | 126/144 |
| 700,664 | 5/1902 | Lee et al. . | |
| 926,910 | 7/1909 | Taylor | 126/120 |
| 1,167,104 | 1/1916 | Ott . | |
| 1,527,679 | 2/1925 | Frost . | |
| 1,611,317 | 12/1926 | Overton . | |
| 2,101,509 | 12/1937 | Räsänen | 126/75 |
| 2,314,627 | 3/1943 | Millikan et al. . | |
| 2,350,948 | 6/1944 | Walker . | |
| 2,390,995 | 12/1945 | Foltz . | |
| 2,499,156 | 2/1950 | Paolella | 126/120 X |
| 2,561,661 | 7/1951 | Hricko . | |
| 2,620,786 | 12/1952 | Mueller . | |
| 2,671,440 | 3/1954 | Dupler . | |
| 2,713,787 | 7/1955 | Rose . | |
| 2,787,260 | 4/1957 | Williams . | |
| 2,847,849 | 8/1958 | Reintjes . | |
| 2,987,856 | 6/1961 | Longenecker . | |
| 3,098,428 | 7/1963 | Maxwell . | |
| 3,289,666 | 12/1966 | Prather . | |
| 3,676,969 | 7/1972 | Moore . | |
| 4,016,859 | 8/1977 | Landowski | 126/120 |
| 4,043,313 | 8/1977 | Sherman . | |
| 4,095,586 | 6/1978 | Selva . | |
| 4,174,700 | 11/1979 | Bartsch . | |
| 4,178,908 | 12/1979 | Trexler . | |
| 4,192,285 | 3/1980 | Nietupski . | |
| 4,214,570 | 7/1980 | Hansmeyer . | |
| 4,250,867 | 2/1981 | Andersen et al. . | |
| 4,263,889 | 4/1981 | Martenson . | |

FOREIGN PATENT DOCUMENTS

| | | | |
|---|---|---|---|
| 50210 | 5/1911 | Austria | 126/70 |
| 159376 | 3/1921 | United Kingdom | 126/70 |
| 564524 | 10/1944 | United Kingdom | 126/120 |
| 832992 | 1/1954 | United Kingdom . | |

*Primary Examiner*—Larry Jones

*Attorney, Agent, or Firm*—Pollock, Vande Sande & Priddy

[57] ABSTRACT

Disclosed is a modular masonry heating system having a modular firebox assembly positioned within the flue chamber of an outer modular heat shell asembly. The heat shell comprises an enclosing wall and a cover each of which is formed from smaller modules and is self-supporting without these modules being secured together by a bonding material. The firebox comprises a foundation, a fire chamber enclosure and a riser each of which is formed from smaller modules and is self-supporting without these modules being secured together by a bonding material. The sets of modules for the heat shell wall and cover and the firebox riser and foundation may each have a different shape but the modules in the same set may have a substantially uniform size and shape. After assembly, the firebox and heat shell are each free-standing independently of the other. The heat shell is in spaced relation to the firebox so that combustion products are drawn past a major portion of the heat shell before being discharged from an exhaust port. There may also be provided an ashpit for receiving ashes from the firebox, plenum means for heating and circulating fresh air to remote spaces, and means for heating and circulating tap water to remote spaces.

25 Claims, 26 Drawing Figures

MODULAR MASONRY HEATING SYSTEM

TECHNICAL FIELD

This invention relates to masonry heating structures for supplying heat to rooms or other spaces in a house or other building, and more particularly to a hot air furnace comprised of modular masonry components.

BACKGROUND OF INVENTION

Brick stoves and fireplaces with multiple or tortuous flues have been used in Europe and Asia for many years, one such structure being commonly referred to as a Russian Stove. Russian Stoves are massive brick and mortar structures which have a series of vertically and/or horizontally disposed flues alternating back and forth to provide a long flow path for products of combustion. In a Swedish stove design, the firebox has vertically extending walls for directing the products of combustion upward into a flue chamber having passageways for carrying these combustion gases downward past exterior portions of the firebox to outlet means located near the bottom of the flue chamber. A similar flue arrangement has been suggested for use in a hot air furnace as shown in U.S. Pat. No. 700,664 to Lee, et al. These flue arrangements are commonly referred to as "Fountain" designs.

The relatively long flow path in these designs allows the surrounding masonry to absorb approximately 80 to 90 percent of the combustion heat and store it for gradual release to a room or other space for a long period after the combustion process has ended. The heat source may be a rapidly burning wood fire which may reach sufficiently high temperatures (about 1,000° F. or greater) to thoroughly burn up all combustible solids and liquids so that there is very little smoke and little or no creosote buildup in the flues. The wood pieces are usually small (less than about 2½ to 3 inches in diameter) to insure a fast burn. Combustion products leave the stove and pass to ambient air by natural convection through an exhaust flue provided by a chimney or stovepipe connected to the stove flues. When the fire has died out at the end of the combustion cycle, which may take as little as twenty to thirty minutes, a damper in the chimney or stovepipe is shut so as to close off the stove flues and reduce the amount of hot air escaping through the exhaust flue. There need be no damper or other mechanism for controlling the entrance of fresh air into the firebox.

The heat generated by such fast burns will cause exterior surfaces of the surrounding masonry structure to reach peak temperature (about 150° F. to 180° F.) within about five hours after a rapid burn has been completed. While not hot enough to burn the skin, these temperatures are hot enough to preclude resting a hand on heated exterior surfaces for more than a few seconds. The large mass of these masonry structures, which may contain six or more tons of brick, will retain considerable heat and may provide steady radiant and convection heat for a room or other space for 12 hours or more. On particularly cold days, two or more consecutive refuelings one after another during a single firing period may be needed to bring the surrounding bricks to their peak temperature before closing the damper. In addition, a second firing period may be needed during a 24 hour period. The number of firings needed per day also depends on the level of insulation in the building being heated. For a well insulated building and normal winter temperatures, one or two rapid burns in a single firing period may be sufficient to provide enough heat for a full day (24 hours).

Prior art masonry fireplaces and stoves have the disadvantage of requiring large numbers of bricks which must be secured together by a bonding material, such as portland cement and the like, and which must be assembled by highly skilled craftsman in accordance with precise construction requirements.

These masonry structures may require two to four weeks for construction alone. In addition, conventional bonding materials, such as portland cement, may have to be cured for an additional three or four weeks after assembly of the stove before it can be fired for actual use as a source of heat.

A further disadvantage of prior art structures is that the masonry firebox is rigidly secured along two or more sides to the flue forming masonry by mortar or other brick bonding material such that thermal expansion and contraction of the firebox relative to the flue masonry can produce excessive thermal stress and unsafe and/or unsightly cracks and/or fractures in the masonry structure. Similarly, the masonry cap or other overlying structure in the Swedish or Fountain design is rigidly secured to the outer wall of the flue chamber. This can also produce excessive thermal stress and cracking, particularly since extremely hot combustion products may impinge directly on the overhead structure and cause this portion of the flue chamber enclosure to expand more rapidly than the remainder during fast-burn firings.

In a masonry stove, the heat energy produced by a hot, fast burning fire established once or twice a day is absorbed by the relatively dense mass of the masonry material which acts as a heat sink so that the walls of the mass then slowly release the stored heat to the surrounding air. Therefore, a principal advantage of a masonry stove is its ability to supply heat over a long period of time after a relatively brief firing. In marked contrast to masonry heating structures, metal stoves and furnaces extract only about 60 percent or less of the heat generated by fuel combustion. Because their heat storage capabilities are relatively limited due to lack of heat storage mass, metal heating systems must be frequently fired to establish a relatively constant level of heat in an adjacent or remote space. Furthermore, woodburning metal units require regulation of the combustion air for controlled burning of the wood so that heat can be supplied over a longer period without excessive fuel consumption. This reduces combustion efficiency and results in a buildup of creosote in the flues and other passageways of such units.

DISCLOSURE OF THE INVENTION

A principal object of the present invention is to overcome those problems and deficiencies of the prior art referred to above. A further object of the invention is to provide a new and improved type of masonry furnace which is relatively easy and inexpensive to assemble and maintain and which consumes relatively little fuel so as to provide heat at relatively low cost to adjacent and remote rooms of a building or other spaces requiring heat.

Another object of the invention is to provide a masonry heating system having a masonry heating unit comprised of standardized sets of modular components which are precast from refractory materials, which are relatively inexpensive to manufacture and which can be quickly and inexpensively assembled into a composite heating unit having a relatively large heat storage mass.

Another object of the invention is to provide a masonry heating system capable of producing radiant heat, conduction heat, convection heat, forced air heat and/or forced water heat and which may serve as a hot air furnace, a hot water furnace, a hot water heater, a heating stove, a cooking stove, a fireplace and/or a source of heat for industrial processes.

Another object of the invention is to provide a heated masonry structure which may extend into or be incorporated into the structure of one or more rooms of a building without distracting from the appearance of such room or rooms.

Another object of the invention is to provide a modular masonry structure that is so constructed as to efficiently absorb and store a large proportion of the heat energy generated by combustion of solid, liquid and/or gaseous fuels and thereafter efficiently release such stored heat energy to a room or other space to be heated for a period of time substantially longer than required for combustion of the fuel.

Another object of the invention is to provide a masonry heating unit having a modular firebox and a modular heat shell which are each freestanding independently of the other and may freely expand and contract relative to each other when heated so as to avoid thermal cracking and/or fracture of either of these masonry components.

Another object of the invention is to provide a modular masonry heating system comprising a firebox enclosed within a heat shell, the firebox comprising a modular fire chamber enclosure for burning a combustible fuel and a modular riser for directing products of combustion against the heat shell and the heat shell comprising a modular enclosing wall and a modular cover, the firebox enclosure, the firebox riser, the heat shell wall and the heat shellcover each being "self-supporting" in the sense that the modules of these sub-components maintain their position and these sub-components maintain their shape and structural integrity such that the heating system may be assembled without bonding material disposed between adjoining modules and/or sub-components.

Another object of the invention is to provide precast refractory modules which can be lifted by one or two persons and minimize the number of separate members required to construct a masonry heating system.

Another object of the invention is to provide a masonry heating system which can be operated with substantial savings in the cost of fuel but without loss of heating comfort.

Another object of the invention is to provide a masonry heating system which can efficiently burn solid fuels without accumulation of tar-like deposits in the firebox and/or combustion product flues and other passageways.

The modular masonry heating system of the present invention and the way in which it accomplishes the foregoing objects will now be described. The smallest members of the masonry heating unit portion of the system comprise precast modules of high temperature refractory cement or other masonry materials capable of withstanding temperatures greater than about 2,000° F., preferably greater than about 2,500° F. and more preferably greater than about 3,000° F. Although there are preferably different modules for different components of this unit, the weight of a single module is preferably limited to about 200 pounds, preferably about 175 pounds and more preferably about 150 pounds. This weight can be readily lifted and placed by two persons.

Two basic components of the heating unit are an outer heat shell assembly and an inner firebox assembly. The heat shell includes a self-supporting enclosing wall and a self-supporting cover which together form a flue chamber. The base of the enclosing wall is supported on a floor, footing or other supporting surface which may be of dirt, concrete or the like. The base of the cover is supported on the enclosing wall. The enclosing wall comprises a set of stacked wall modules preferably of a substantially uniform size and shape. The cover may be a single slab but preferably comprises a set of stacked cover modules of a substantially uniform size and shape. Each of the wall and cover modules preferably has an elongated body of a length substantially greater than its width and substantially greater than its height and engaging means for engaging an adjoining module so as to form self-supporting wall and cover structures. While these two sets of modules may be of the same shape, the shape of the cover modules is preferably different from the shape of the wall modules which have elongated bodies that may be linear for forming an enclosing wall of rectangular or triangular shape or may be curved for forming an enclosing wall of circular or semi-circular shape. The wall modules preferably have joint means at each end for forming a structural joint with an abutting wall module. The joint means form a structural joint when the wall modules are in either perpendicular or longitudinal end-to-end abutment. Perpendicular abutment allows formation of a corner between two wall sections, such as a front wall section and a sidewall section. Longitudinal abutment allows the length of a wall section to be doubled or some other multiple of the wall module length (minus the overlap). The heat shell formed by the enclosing wall and the cover is also a self-supporting structure without the cover being secured to the top of the wall by a bonding material.

Although the firebox may be of unitary construction, it is preferably comprised of smaller components and these sub-components are preferably comprised of still smaller precast modules. The basic component of the firebox is a fire chamber enclosure which may be of unitary construction or comprised of stacked annular or U-shaped modules, but is preferably comprised of modules in the shape of rectangular plates, including bottom, sidewall, top and rear plates. These plates may be of different sizes and shapes or of substantially uniform size and shape and are arranged to form a fire chamber for burning a combustible fuel. The sidewalls stand on edge and extend vertically to direct the products of combustion upward into the flue chamber so as to heat one or more interior surfaces of the heat shell. This combustion heat is then transmitted by conduction to one or more exterior surfaces of the heat shell.

To improve the efficiency of heat transfer from the combustion products to the heat shell, the firebox preferably includes a riser with a flue for directing combustion products against the heat shell cover. The riser forms a passageway between the firebox and the heat shell for directing the combustion products from the cover downward around the exterior of the firebox to an exhaust port located at or near the bottom of the flue chamber. The riser may be of unitary construction but preferably comprises a set of annular modules of substantially uniform size and shape stacked so that the annulus of each module forms part of the riser flue for conveying combustion products from the fire chamber to the top of the flue chamber. The horizontal cross-sectional area of the riser flue is preferably less than the horizontal cross-sectional area of the fire chamber. In this embodiment, the firebox includes a top wall comprised of one or more modules for enclosing that portion of the fire chamber top which is not covered by the riser.

The bottom of the fire chamber is preferably supported above the floor of the flue chamber by a foundation which also may be of modular construction. The foundation modules preferably support the fire chamber above the exhaust port for exhausting the flue chamber so that combustion products leaving the firebox riser are drawn downward past a major portion of the heat shell wall and beneath a portion of the firebox before being discharged from the flue chamber into a conventional chimney flue or exhaust flue pipe. The foundation components are preferably of substantially the same size and shape. The foundation modules may form exhaust baffles and/or an exhaust plenum for causing combustion products to flow under at least a portion of the fire chamber before being exhausted from the flue chamber. The foundation modules also may form an ashpit beneath at least a portion of the bottom plate of the fire chamber. In this preferred embodiment, the bottom plate contains an aperture for dumping ashes into the ashpit.

Appropriate openings may be formed in the heat shell for introducing fuel and combustion air into the fire chamber, for exhausting combustion products from the heat shell and for removing ash from the asphit. Precast openings in some of the wall modules may be provided for these purposes or appropriate openings may be cut in standard wall modules either during manufacture or during on site assemble of a particular masonry heating system.

In a preferred embodiment, the bottom and sidewall modules and a top module of the fire chamber enclosure are arranged adjacent to the fuel opening and in abutting relationship with the heat shell wall so that a portion of the heat shell wall forms a front wall of the fire chamber. Although a door over the fuel opening is not required, a fire chamber door may be mounted within the fuel opening or on one or more of the heat shell modules adjacent to this opening.

The modular masonry heating unit of the present invention may be constructed entirely within the space to be heated, such as a living space in a house, or it may be constructed partially within one or more of the spaces to be heated, such as partially within a basement and partially within a room thereabove. For example, the fire chamber portion may be placed in the basement of a house and the upper portion of the heat shell may protrude into a living room thereabove. Where the fire chamber is located within a living space, the firebox may be designed as a fireplace and those portions of the heat shell within the room may have a brick facing or other aesthetic covering compatible with the room decor.

Where the masonry heating unit is located entirely within the basement and the heating of remote living spaces is desired, all or a portion of the heat shell may be surrounded by a fresh air plenum for directing either forced or natural convection air over hot exterior surfaces of the heat shell. The heated air is then conveyed to one or more remote living spaces by conventional hot air ducting. Where forced air heating is desired, the fresh air plenum may be tied into a conventional heating and/or air conditioning system so that previously installed blowers and ducting may be used to circulate air through the plenum of the masonry system. Alternately, this plenum may have its own blower and hot air supply and cold air return ducting. In a preferred embodiment, the plenum itself is comprised of conventional modular components such as plastic or metal sheets or plaster board or other masonry sheets. Where plaster board is used, it is preferably of a high temperature or fire resistant type.

The enclosing wall and cover of the heat shell and the fire chamber enclosure and riser of the firebox are each self-supporting structures without the individual modules of these components being secured together by a bonding material, such as mortar. However, use of a bonding material between these modules is not excluded and a sealant material between adjoining modules is preferred to confine fresh air and combustion gases to their repsective chambers and passageways. The modular firebox and the modular heat shell are preferably each freestanding structures supported independently of the other on a footing or other substantially flat surface. This supporting surface preferably comprises the floor of the flue chamber surrounded by the heat shell. Although the firebox foundation and heat shell base may be bonded to their respective supporting surfaces to prevent the firebox and heat shell from grossly shifting relative to each other, these bonded connections are not required for structural support and do not deprive these components of their freestanding characteristics which prevent thermal expansion and contraction of one components from causing thermal cracking or fraction in the other. In other words, the firebox and heat shell are each still free to expand and contract without inducing substantial thermal stresses in the other. Although a sealant may be provided between the fire chamber enclosure and the heat shell wall around the fuel opening, there is preferably no rigid masonry connection between the fire chamber enclosure and the heat shell. Even if a bonded mortar connection is made initially at this juncture during assembly of the unit, the rigid connection will quickly fracture upon firing so that these components can freely expand and contract relative to each other.

It follows from the foregoing that the modular heating unit of the present invention is simpler to construct and less subject to thermal stress than prior heating units of the masonry type. Whereas prior art designs may require two to four weeks to assemble and an additional three or four weeks to cure, the heating unit of the present invention can be assembled in less than 12 hours. The sealants which are preferably used between adjoining modules will cure in less than 24 hours, more preferably in less than 12 hours.

Other advantages of the invention include the provision of a masonry heating system which is easy to assemble and maintain. Because of its relatively long flow path for combustion gases, the masonry heating unit absorbs greater than about 80 percent, preferably greater than about 85 percent and more preferably greater than about 90 percent of the heat of combustion. Combustion air may be allowed to enter the fire chamber at several locations to provide a very fast, very hot burn and no combuston air regulation is required. The masonry heating unit thus eliminates the need to match the rate of burn to the heat requirements of the building or other space to be heated so that the fuel may always be burned at its most efficient rate. As a result of plenty of fresh air and rapidly combustible fuel, temperatures inside the firebox and connected flues may rise to between about 1,200° F. and about 1,500° F., at which temperatures all combustible liquids and gases given off by solid fuels are also ignited, thereby reducing atmospheric pollution and condensation and accumulation in the flues of the sticky, tar-like substance known as creosote. Ash removal may be infrequent since relatively little ash is produced due to the completeness of the burn.

The system disclosed is particularly useful in schools and other community and/or commercial buildings which generate large quantities of paper or other combustible waste which can be compacted and used as solid fuel for the fire chamber. The system is also useful for heating greenhouses which have been adversely impacted to a significant degree by the rising costs of oil and gas. In addition, the system may serve as a domestic hot water installation by placing heating coils within the fire or flue chambers so as to provide heated potable water.

The system disclosed has the further capability of utilizing combinations of both solid fuels and gaseous and/or liquid fuels. Thus, an oil or gas burner may be provided in the fire chamber with appropriate fuel supply connections passing through both fire chamber and heat shell walls. One or more such burners may serve as backup or auxiliary sources of hot combustion gases where solid fuel is unavailable or an automatic heat source is desired in the absence of personnel or an automatic system to stoke a solid fuel fire. Where an automatic firing component is provided, the system should include means for automatically opening and closing the flue damper before initiation and after termination, respectively, of each firing sequence. The heat provided by the masonry heating unit can be distributed through conventional hot water and/or hot air circulation systems.

The system disclosed is highly versatile in that heat from the heating unit can be transferred by radiation, convection, direct radiant heat, conduction, natural convection air and/or water, and/or forced air and/or water. The fire chamber of this unit can be used as a fireplace while burning fuel and as a cooking oven after termination of a burn. Firing can be done whenever convenient since the heat stored in the masonry structure is available for heating many hours after a previous firing has been completed. As a result of fuel efficiency and versatility, heating costs for the average home may be reduced substantially below the costs of conventional gas or oil fired units. Except for the fuel loading door, the fire is contained in a solid masonry container which does not get sufficiently hot to burn the skin if accidentally touched. The system is therefore exceptionally safe, especially where the fire chamber is located in the basement of a building remote from inhabited spaces.

A further advantage of the invention is that the precast modules may be sold and delivered to homeowners or other buyers as a kit to be assembled by the buyer himself. The modules for the kit can be easily inventoried and stored by manufacturer and then assembled into kits shortly before delivery to individual buyers or to regional distributors and/or area retailers. As an alternative, buyers may be supplied with kits comprised of forms and refractory materials for casting their own modules at or near the site on which the modular masonry heating system is to be assembled. The modules, whether precast by a manufacturer or by an ultimate user, may be of various preselected sizes depending upon the size and capacity of the final heating system desired. Where the modules are available in one or two standard sizes, their design is such that the size of the heating unit portion may be a multiple of the smallest size unit formed by a single kit of the basic modules. For example, the size of a rectangular heat shell may be doubled by using two stacks of enclosing wall modules for each side section of the heat shell so that the depth of the heat shell is twice that of the basic unit but the width to be spanned by the cover modules remains the same.

BRIEF DESCRIPTION OF THE DRAWINGS

The invention may be further understood by reference to the accompanying drawings in which.

DESCRIPTION OF BEST AND OTHER MODES

Figure 1:
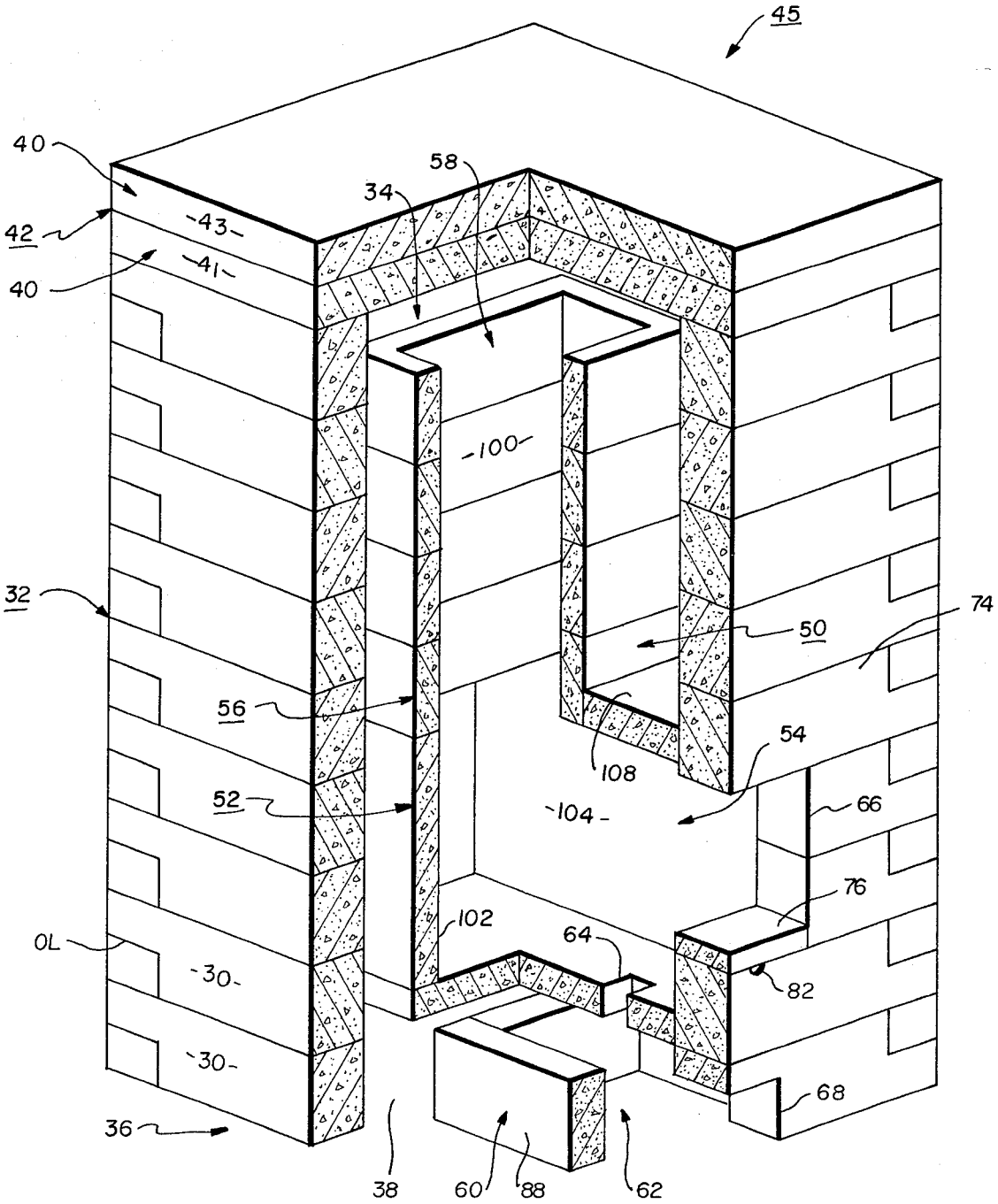
FIG. 1 is a perspective view of the invention in partial section.

With reference to FIGS. 1 through 5, there is illustrated a preferred mode for carrying out the present invention. As shown in these figures, a plurality of wall modules 30 are stacked one atop the other to form a rectangular wall 32 enclosing a flue chamber 34. Modules 30 are each precast from refractory material. Enclosing wall 32 is supported on a substantially flat supporting surface 36, which may be a dirt floor, a concrete slab or other footing. Surface 36 forms a floor 38 at the bottom of flue chamber 34. A pair of cap members 40—40 are supported by the upper edge of wall 32 so as to form a cover 42 spanning over the opposing wall sections and comprising the top of flue chamber 34. Cap members 40—40 may comprise single, unitary slabs 41 and 43 each precast from refractory material as shown in FIG. 1. Enclosing wall 32 and cover 42 together from a masonry heat shell assembly 45.

Figure 2:
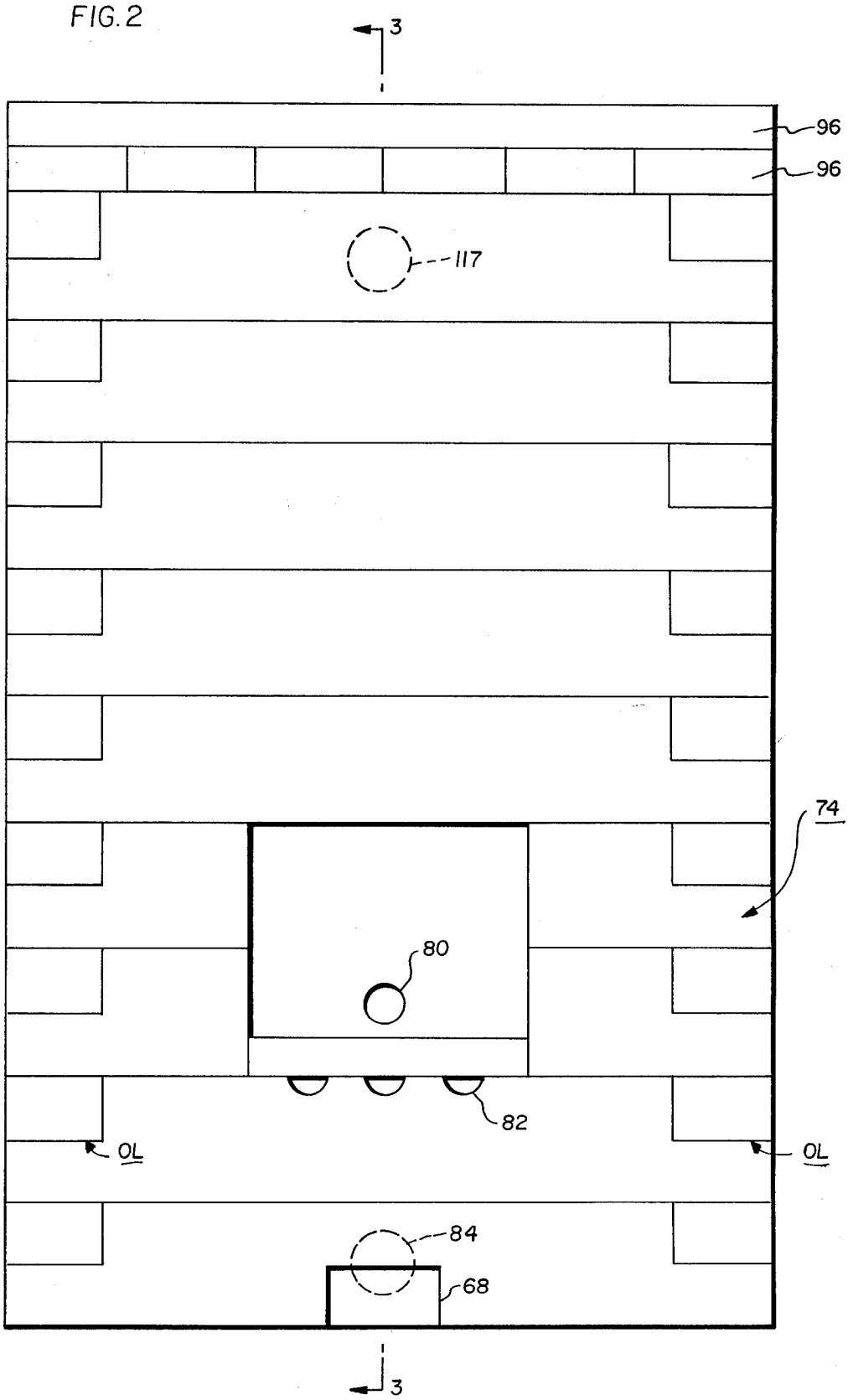
FIG. 2 is a front elevational view of the invention.
Figure 5:
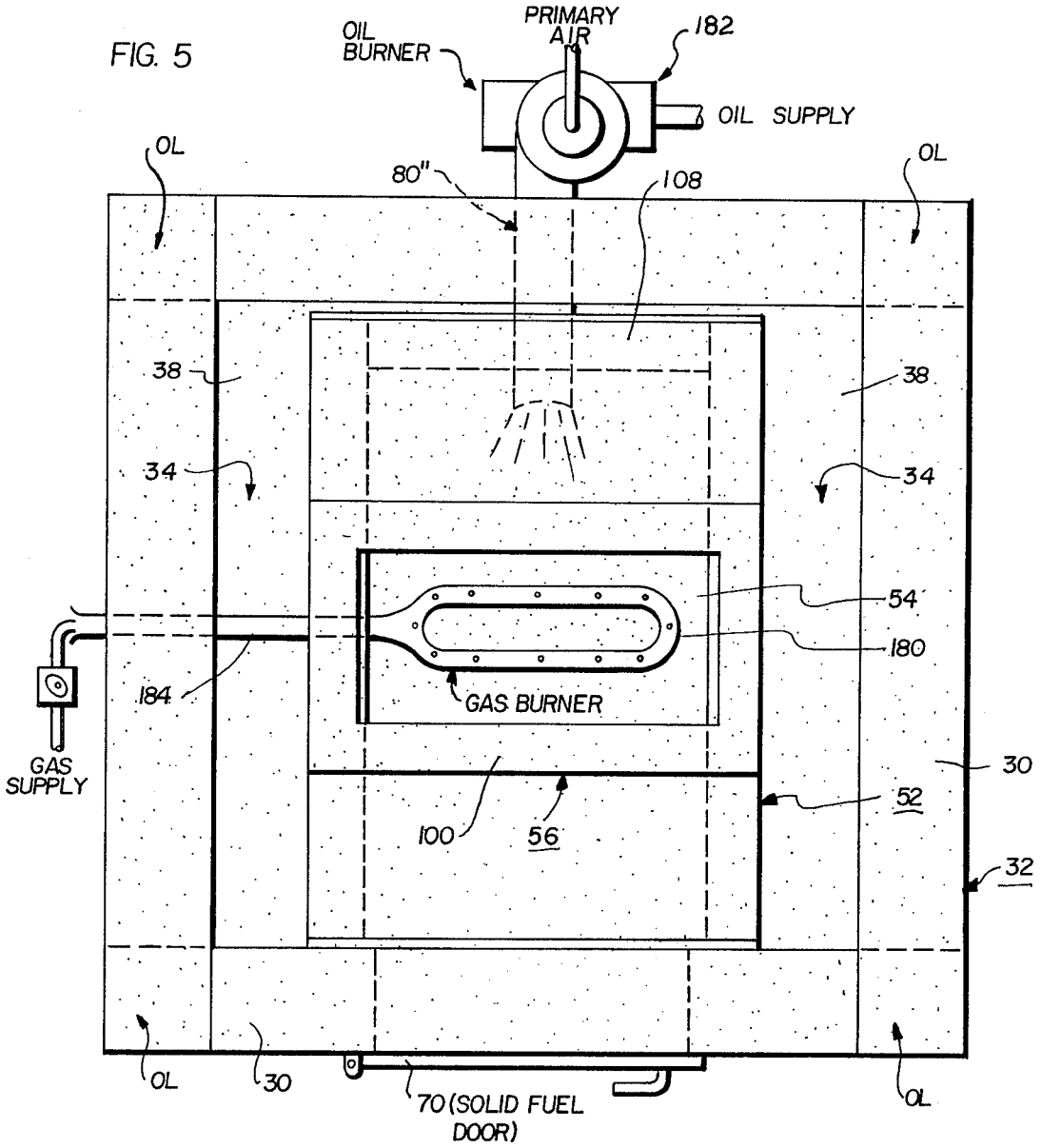
FIG. 5 is a top plan view in section taken along lines 5—5 of FIG. 3 and showing other optional features of the invention for burning gaseous and/or liquid fuels in place of or in addition to solid fuels.

Wall modules 30 preferably have a substantially uniform size and shape and each comprise a rectangular, elongated body with a projecting tongue at each end for overlapping the projecting tongue of an abutting wall module as illustrated at "OL" in FIGS. 1, 2 and 5. The stacked, overlapping arrangement of wall modules 30 make heat shell wall 32 self-supporting. Heat shell cover 42 is also self-supporting since cap members 40—40 each span the full distance across flue chamber 34 and are supported by opposing sections of wall 32. It follows from this that heat shell 45 is a self-supporting, freestanding structure when assembled as shown and that no bonding material is required between adjoining modules.

Figure 3:
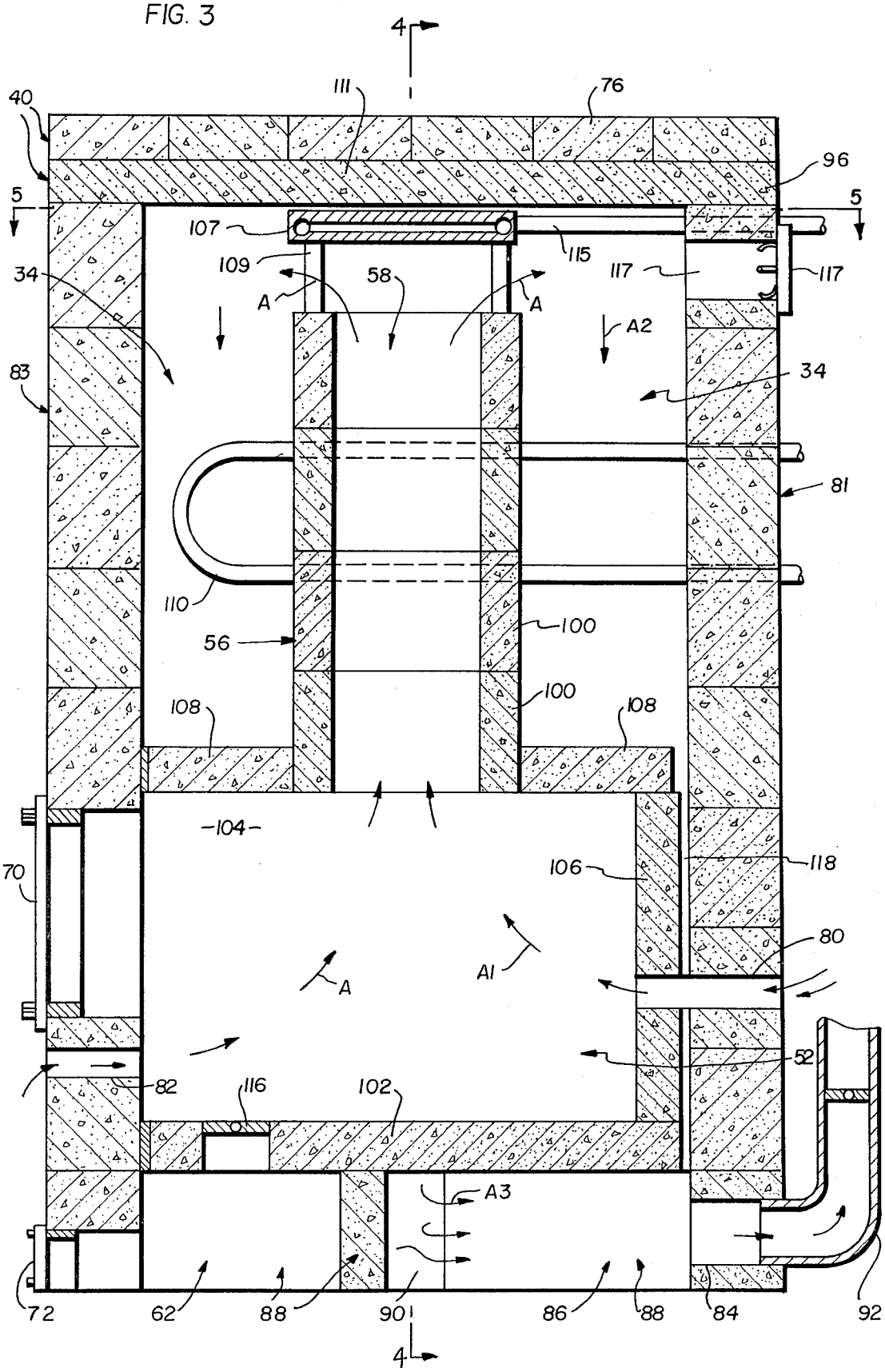
FIG. 3 is a side elevational view in section taken along lines 3—3 of FIG. 2 and showing certain optional features of the invention for heating water.
Figure 4:
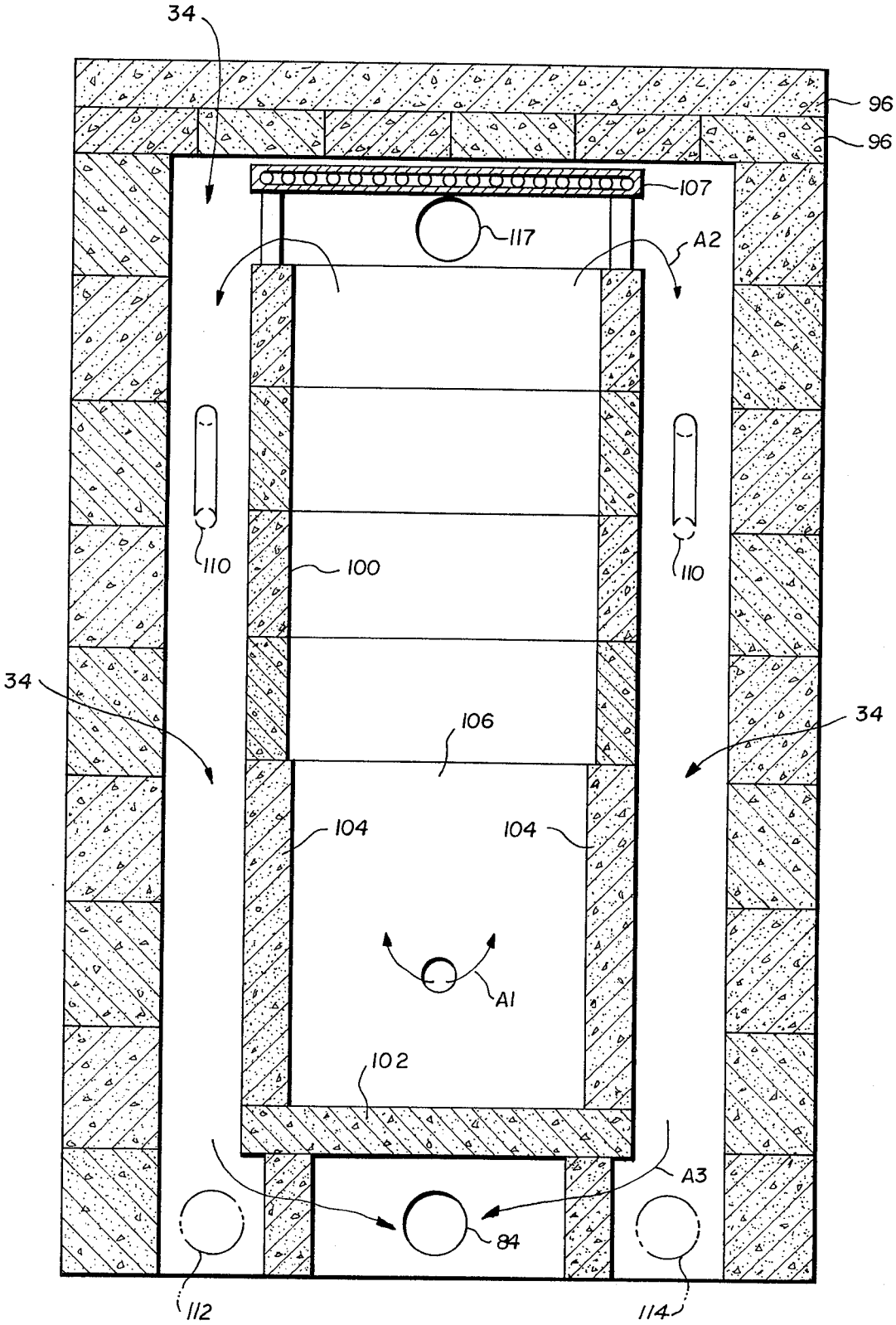
FIG. 4 is a front elevational view showing the invention in section taken along lines 4—4 of FIG. 3.

With reference to FIGS. 2, 3 and 4, each cap 40 of heat shell cover 42 is preferably comprised of a plurality of smaller elongated modules 96 instead of a single, unitary slab. Modules 96 are preferably of substantially uniform size and shape. So as to improve the self-supporting characteristic of the cover, the set of modules comprising the lower cap extend longitudinally from front to back and the set of modules comprising the upper cap extend longitudinally from side to side or vice versa.

Within flue chamber 34 is a firebox assembly, generally designated 50, for burning a combustible fuel, such as wood, coal, gas and/or oil. The firebox assembly includes three main components, namely, an enclosure 52 forming a fire chamber 54, a riser 56 forming an upwardly extending riser flue 58 and a foundation 60 for supporting fire chamber enclosure 52 above the level of floor 38. As shown best in FIGS. 1 and 3, foundation 60 preferably forms an ashpit 62 into which ashes may be dumped from fire chamber 54 by means of an aperture 64 in the bottom of fire chamber enclosure 52.

Although enclosure 52, riser 56 and foundation 60 may each be unitary components stacked one atop the other, each is preferably further componentized so as to be assembled from smaller modules as described below. An important feature of the invention is that regardless of whether these components are unitary modules or further componentized, foundation 60, fire chamber enclosure 52 and riser 56 are each self-supporting and in turn form a firebox assembly which is also self-supporting and is freestanding on floor 38 independently of heat shell assembly 45.

In the preferred modular construction of firebox assembly 50, riser 56 is comprised of riser modules 100 of a substantially uniform size and shape. Modules 100 preferably have an annular shape and are arranged in a stacked relationship with the annulus of each forming part of riser flue 58. Foundation modules 88 are preferably also of a substantially uniform size and shape. On the other hand, fire chamber enclosure 52 preferably comprises a plurality of non-uniform modules, including a bottom plate 102, a pair of opposing side plates 104—104 of substantially the same size and shape, a rear plate 106, and a pair of cover plates 108—108 of substantially the same size and shape. Cover plates 108—108 are preferably arranged on either side of riser 56 as shown in FIG. 3.

As previously indicated, the modular components of heat shell 45 and firebox 50 are each self-supporting and have means cooperating with an adjoining component to form self-supporting structures without the necessity of bonding material between adjoining modules. In addition, the heat shell and the firebox are freestanding on surface 36 independently of each other.

As shown best in FIGS. 1 and 2, an opening 66 is provided in the front section of wall 32 for introducing solid fuel into fire chamber 54 and an opening 68 is provided below opening 66 for removing ash from ashpit 62. These openings may be left open at all times or optionally hinged doors 70 and 72 may be provided for openings 66 and 68, respectively, as illustrated in FIG. 3. Such openings either may be cut in wall modules 30 as illustrated by opening 68 or special modules may be precast to form an opening as illustrated by modules 74 to either side of opening 66. To adjust the height and size of opening 66, a filler block, such as block 76, may be employed along the lower edge of the opening.

Where openings 66 and 68 are covered by a door, additional openings may be provided for introducing fresh combustion air into the fire chamber as best shown in FIGS. 2 and 3. For example, a pipe 80 may penetrate rear wall section 81 of the heat shell and rear wall 106 of the fire chamber enclosure to introduce fresh air into the back of the fire chamber. Similarly, a series of channels 82 may be cut through the forward heat shell wall so as to introduce fresh air into the front of the fire chamber. The oxygen in the incoming fresh air promotes combustion of the fuel within fire chamber 54 and riser flue 58. The resulting combustion products travel up the riser flue into the top portion of flue chamber 34 where they are drawn downward past exterior walls of the firebox by an exhaust draft created by an exhaust port 84 at or near the base of rear wall section 81 of the heat shell, the flow path of combustion air and combustion products being indicated in FIGS. 3 and 4 by arrows "A".

An exhaust plenum 86 is preferably formed adjacent the entrance to exhaust port 84 by positioning two foundation blocks 88 so as to abut heat shell section 81 on either side of port 84 and form a channel or slot 90 between the forward end of each of these blocks and the rear block of ashpit 62. This causes the downwardly flowing combustion products to pass inwardly under at least a portion of the fire chamber enclosure before being exhausted through port 84 as illustrated by arrows A1, A2 and A3 in FIGS. 3 and 4. Exhaust port 84 discharges combustion products to ambient air through an exhaust pipe 92 which may pass through a building directly to ambient air or which may be connected to a standard chimney flue. Pipe 92 contains a damper 94 which is opened during firing and closed after the fire has died down (solid fuels) or has been cut off (gaseous or liquid fuels).

Inspection and clean out ports 112 and 114 are provided on either side of exhaust port 84 as shown in phantom outline in FIG. 4. An inspection and clean out port 117 is preferably also provided in the rear heat shell section at or near the level of the top of riser 56. Port 117, as well as ports 112 and 114, are normally covered by a closure member 119 having means for frictionally engaging internal surfaces of the port as illustrated for port 117 in FIG. 3 as an optional feature, a butterfly valve 116 may be provided in the ash dump formed by aperture 64 in bottom plate 102 of the fire chamber enclosure.

If the masonry heating system is also to be used as a source of hot water, a fireplate 107, such as that made by Fireline, Inc., of Fryeburg, Maine, may be supported over riser flue 58 so as to be directly in the path of combustion products discharged toward cover 42 by riser 56 as shown in FIGS. 3 and 4. The fireplate may be supported at each of its four corners by support blocks 109 or it may be suspended from cover 42. Fireplate 107 contains a plurality of water channels 111 connected by an inlet pipe 115 and a corresponding outlet pipe (not shown) to a tank or other reservoir of heated water.

The water supply system (not shown) preferably includes a circulating water pump which is thermostatically operated in response to the flue gas temperature as measured by thermal couples located either in inspection port 117 or in exhaust pipe 92. The set point for operating the pump is preferably about 130° F. Flue chamber 34 also may optionally contain a pair of water heating coils 110—110 as shown in these figures.

Although the various components and their corresponding modules do not need a bonding material for structural strength, it is preferable to use a sealant between adjoining heat shell modules so as to prevent fresh air from being drawn between those modules and into the flue chamber. Similarly, a sealant material is preferably used between adjoining firebox modules to prevent combustion products from passing between these modules and into the flue chamber without first traveling up riser 52.

As shown best in FIG. 3, firebox modules 102, 104—104 and 108 are preferably arranged in abutting relationship to front section 83 of enclosing wall 32 so that a portion of the heat shell wall forms a front wall of fire chamber 54. Although the same sealant material as used elsewhere may be used between this firebox to heat shell abutment, the material selected is preferably flexible so as to form an expansion joint between the heat shell and the firebox. Although a rigid material will quickly fracture due to thermal stresses, it may still form a satisfactory seal if the fracture is of sufficiently close tolerance. Since rear plate 106 is spaced from rear heat shell section 81 by a distance sufficient to form a significant air gap 118 (at least about ½ inch across), an abutting relationship between the front of the firebox and the front of the heat shell should not cause significant thermal cracking of either of these units, even if the sealant material at this juncture is of a rigid mortar type. FIG. 5 is a plan view further illustrating the independently freestanding arrangement of the firebox relative to the heat shell. Because of this arrangement and the self-supporting modular construction of each of these units, it is contemplated that a rigid bonding material may be used instead of a flexible sealant between stacked and other adjoining modules of both the heat shell and the firebox with much less thermal cracking than occurs with prior art masonry heating systems.

FIGS. 6 through 11 show enlargements of the heat shell modules. Standard wall modules 30 have an elongated body 130 with projecting tongues 132 at opposite ends. Elongated body 130 has a length substantially greater than either its height or thickness and is preferably of rectangular cross-section with flat upper and lower surfaces for frictionally engaging adjoining modules both above and below. Tongues 132 are also preferably rectangular with a length and width (depth) that is substantially the same and a height substantially equal to one-half the height of elongated body 130. When the tongue of one module overlaps the tongue of another module with the modules positioned in either longitudinal or perpendicular end-to-end abutment, a joint is formed which has substantially the same cross-section as elongated body 130. Although tongues at opposite ends may extend longitudinally outward from different faces of body 130 as illustrated by tongue 134 shown in phantom outline in FIG. 6, opposite tongues 132—132 preferably extend longitudinally outward from the same face of body 130 for ease of casting and assembly.

Figure 24:
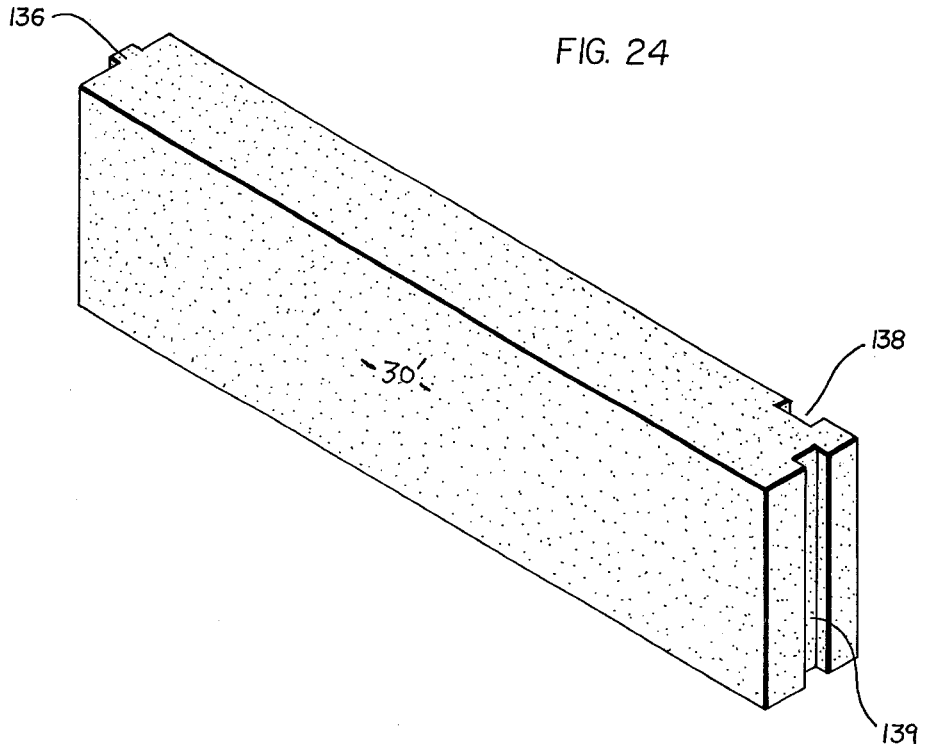
FIGS. 24 and 25 are perspective views illustrating a modification of the heat shell module of FIGS. 6 and 7.
Figure 25:
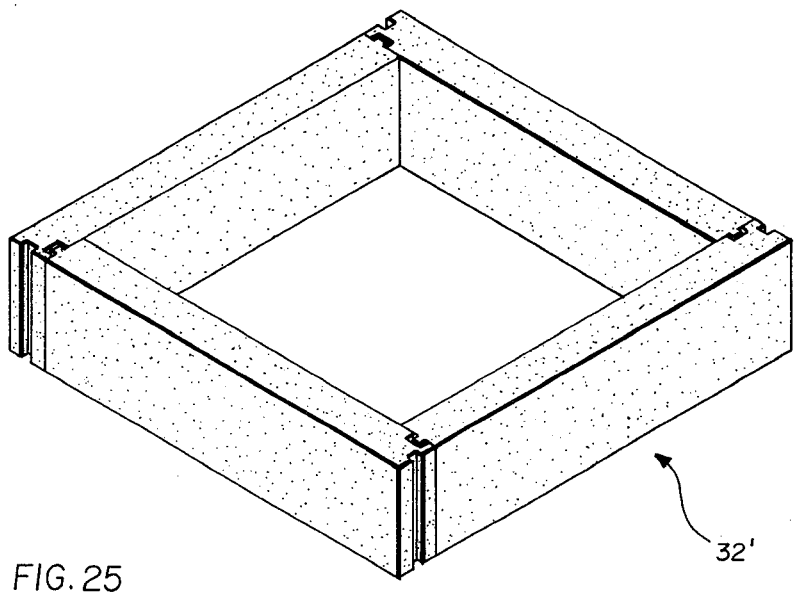

A further modification of the joining means is illustrated in FIGS. 24 and 25 by modules 30 which have a vertical tongue 136 that may be received either in a side groove 138 when two modules are positioned in perpendicular abutment or in an end groove 139 when two modules are positioned in longitudinal (axial) abutment. Four modules 30' may then be arranged in perpendicular abutment to form a heat shell wall 32' as shown in FIG. 25 or two modules may be placed in longitudinal abutment to extend the length of a wall section.

Figure 9:
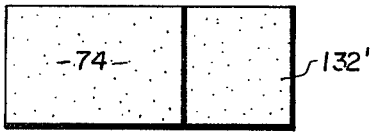
FIGS. 7, 9 and 11 are top plan views, respectively, of different modules of the heat shell assembly of the invention.
Figure 8:
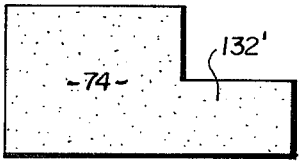
FIGS. 6, 8 and 10 are side elevational views

FIGS. 8 and 9 show an enlargement of fuel opening modules 74 which may be either precast in the size and shape shown or cut from standard size modules 30. Modules 74 have a tongue 132' at one end for mating with the tongues 132 of modules 30. The opposite end of modules 74 is planar so as to frame fuel opening 66.

Figure 10:
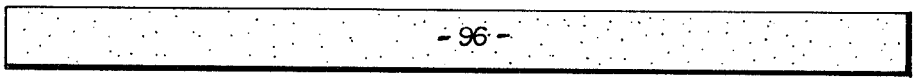
Figure 11:
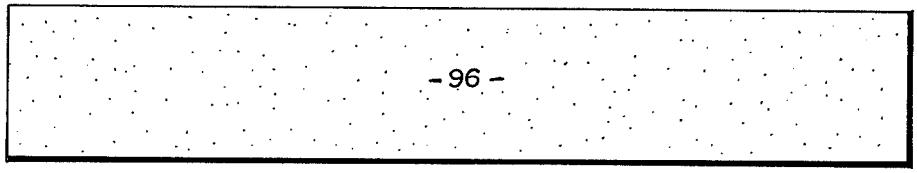

FIGS. 10 and 11 show an enlargement of elongated cover modules 96 which preferably have a substantially uniform rectangular shape and a length sufficient to span the distance between the sidewall and/or front and rear wall sections of heat shell 45. The length of modules 96 is substantially greater than their width or height. Where the sidewall sections are equal in length to the front and rear wall sections, modules 96 in one cap 40 may be positioned perpendicular to modules 96 in the other cap 40 as illustrated in FIGS. 3 and 4. Where the depth of the heat shell is greater than its width, such as when two stackes of modules 30 are used in forming each opposing sidewall section, the longitudinal span of modules 96 is in the same direction for both caps 40—40, namely from sidewall to sidewall. As a further alternative, caps 40—40 may each be of a unitary construction as illustrated by slabs 41 and 43 in FIG. 1.

Figure 12:
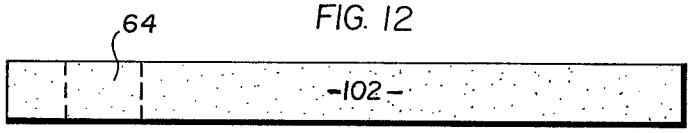
Figure 13:
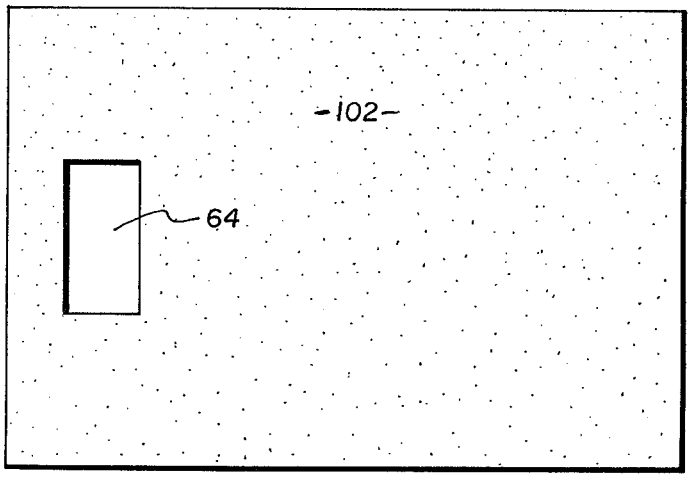
Figure 17:
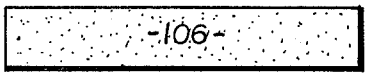
Figure 15:
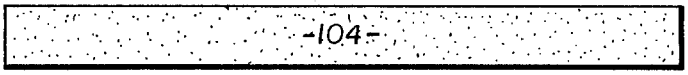
Figure 16:
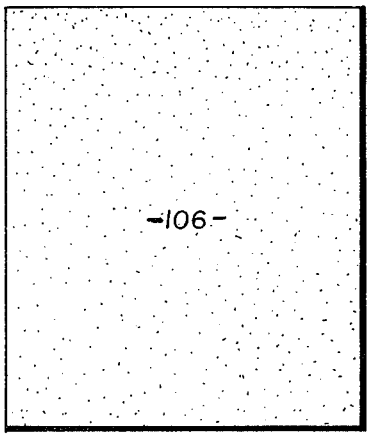
Figure 14:
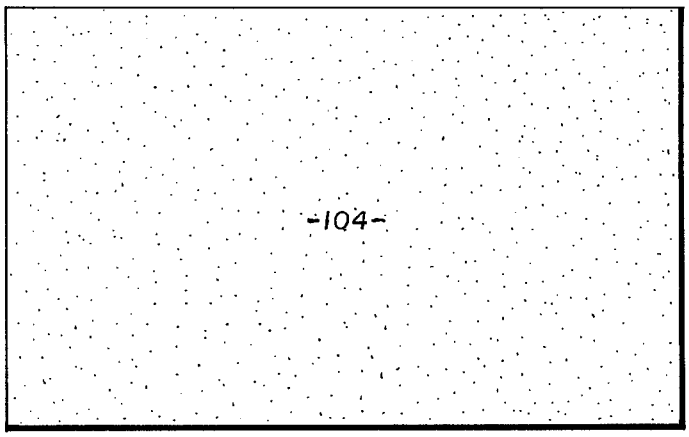
Figure 20:
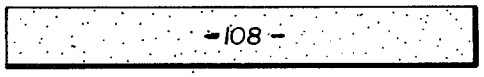
Figure 21:
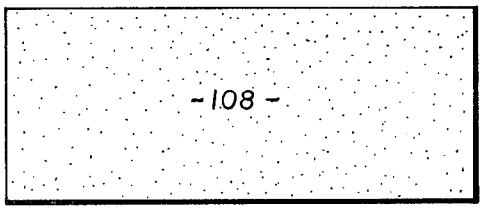

FIGS. 12, 13, 14, 15, 16, 17, 20 and 21 show enlargements of firebox modules 102, 104, 106 and 108 for forming fire chamber enclosure 52. The depth and width of bottom plate 102 are substantially greater than its height (thickness) as shown in FIGS. 12 and 13. The depth and height of sidewall plate 104—104 are substantially greater than their width (thickness) as shown in FIGS. 14 and 15. The width and height of back wall plate 106 are substantially greater than its depth (thickness) as shown in FIGS. 16 and 17. The depth and width of top plates 108—108 are substantially greater than their height (thickness) as shown in FIGS. 20 and 21.

Figure 18:
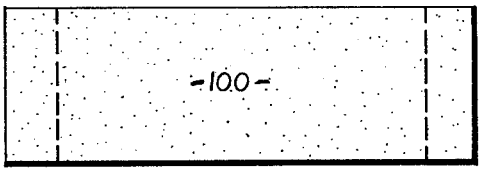
Figure 19:
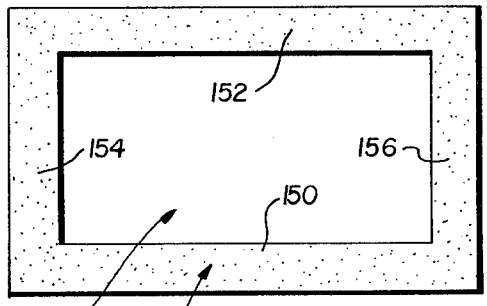

FIGS. 18 and 19 show an enlargement of riser modules 100. These modules preferably comprise front and rear opposing walls 150 and 152, respectively, and opposing sidewalls 154 and 156. These four walls form and surround an annulus 158 as shown in FIG. 19. The width and depth of these modules are substantially greater than their height as shown in these figures.

Figure 23:
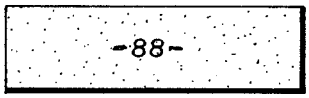
FIGS. 13, 15, 17, 19, 21 and 23 are top plan views, respectively, of different modules of the firebox assembly of the invention.
Figure 22:
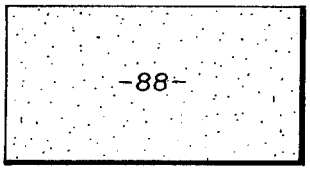
FIGS. 12, 14, 16, 18, 20 and 22 are elevational views
Figure 7:
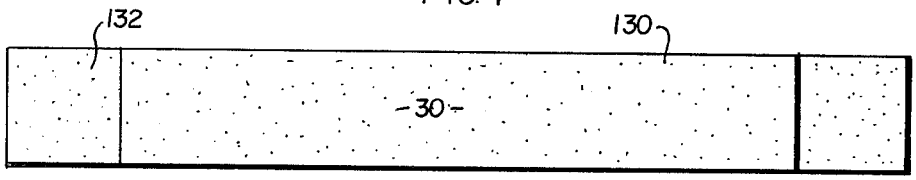
Figure 6:
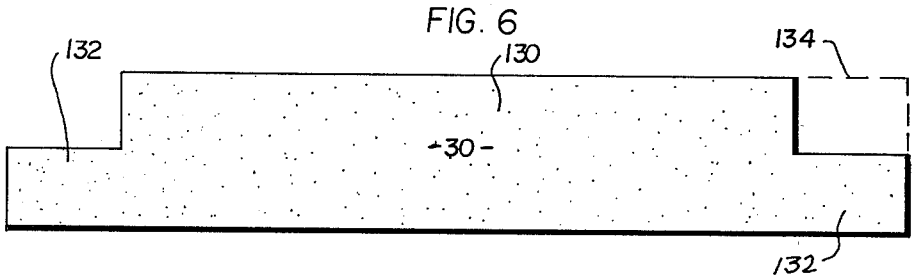

FIGS. 22 and 23 show enlargements of firebox modules 88 for forming foundation 60 which may comprise an exhaust plenum and an ashpit. The height and length of these modules are substantially greater than their thickness as shown in these figures.

The heat shell modules are preferably of a composition comprising a trap rock and rock dust aggregate with a binder of calcium-aluminate cement. The trap rock is preferably ⅜ inch in size and the acceptable types of rock include GabbroDiorite, Volcanic Igneous, Diabase and/or Basalt. Aggregates of this type are available from T. J. Keating, Inc. of Lunenburg, Mass. Acceptable cement binders include Fondu available from Lone Star Laferge, Inc. of Norfolk, Va., and Lumnite available from Universal Atlas Cement Company, a division of United States Steel. Although the cover or cap of the heat shell may be cast from the foregoing materials, the aggregate for these modules is preferably expanded shale available from Keating under the name Norlite.

The fire chamber enclosure and riser of the firebox are preferably of a composition comprising extra-strength, high temperature refractories of the castable type such as fireclay castable refractories available from Harbison-Walker Refractories, a division of Dresser Industries, Inc. of Pittsburgh, Pa., under the name of H-W ES Castable. Another acceptable castable refractory is known as Kast-Set available from A. P. Green Firebrick Company of Mexico, Mo. Although castable refractory materials are also acceptable for the firebox foundation, the foundation modules may comprise conventional cement blocks since they are in a relatively cool portion of the heat shell.

Although a bonding material is not required between adjoining modules and components of the masonry heating system disclosed, bonding mortars also have the desirable characteristics of a sealant and may be used between adjoining modules for this purpose. An acceptable sealant mortar of the high temperature, air-setting type is available from A. P. Green Firebrick Company under the name Sairset or Sairbond.

Figure 26:
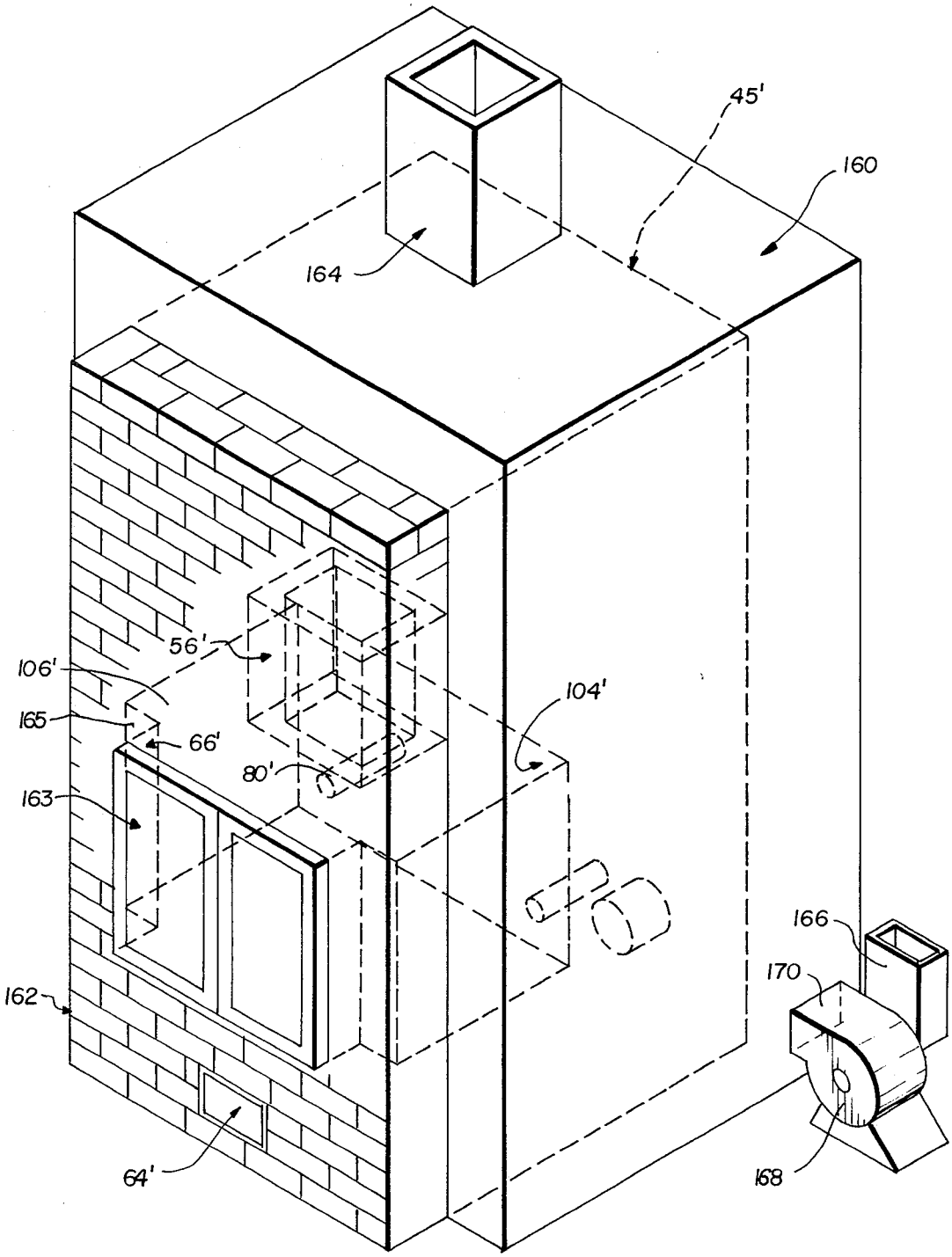
FIG. 26 is a perspective view illustrating a modification of the invention in which a portion of the heat shell is enclosed in a fresh air plenum and the firebox is arranged to serve as a residential fireplace.

A heat shell 45' made in accordance with the invention may be partially (or completely) surrounded with a fresh air plenum 160 as illustrated diagrammatically in FIG. 26. In this embodiment, the rear portion of the heat shell is enclosed in the plenum and the front section of the heat shell wall extends into a room to be heated, such as a recreation room in the basement of a house. A decorative facing, preferably of masonry material such as conventional bricks 162, may be placed in conductive contact with the front section of the heat shell wall so as to radiate heat into the room in which it is located. The longest dimension of the firebox is positioned in abutment with the front section of the heat shell and the fuel opening is enlarged so that the firebox may serve as a fireplace having dimensions approximating those of a conventional fireplace. The positions of fresh air inlets 80'—80' and ashpit 64' are similarly adjusted. The fuel opening in the heat shell may be covered by a conventional screen or folding glass panel 163 as currently available for fireplace installations. For this embodiment, riser 56' is supported on top modules 108' and one of the side modules 104 is cut to serve as two smaller modules 165—165 one on either side of opening 66'.

Plenum 160 is connected to rooms remote from heat shell 45' by hot air ducting 164 and return air ducting 166. Although the heating of remote rooms and/or other spaces may be by natural convection heat, forced air heat is preferably provided by installing a conventional blower 168 and an air filter 170 in the return air ducting 166. Alternately, a portion of the forced air from a conventional heating and/or air conditioning system may be diverted through duct 166 so as to convey heat from heat shell 45' to remote areas. Where combined with a conventional system, the present invention may serve as the primary heat source with backup and/or auxiliary heat provided by a conventional hot air furnace.

As a further alternative, conventional oil and/or gas burners may be installed directly in fire chamber 54 so as to provide an auxiliary or backup source of fuel for the masonry heating system as shown in FIG. 5 where an oil burner 178 and/or a gas burner 180 is provided in fire chamber 54. The proper combustion mixture is supplied to oil burner 178 from a conventional fuel supply and ignition system, generally designated 182, which passes into the firebox through inlet penetration 80''. A supply of gas and primary air is connected to burner 180 by means of a conduit 184 which penetrates the sidewalls of both the heat shell and the firebox. In these embodiments, secondary combustion air inlets similar to inlets 82 of FIG. 2 may be provided as desired and may include dampers so that the amount of secondary combustion air provided may be adjusted so as to be compatible with the auxiliary burner system.

To operate the masonry heating system after it has been assembled from the various modules, a fire is ignited in fire chamber 54 and fuel supplied so as to burn at high intensity. Where solid fuel (wood, coal, waste paper, etc.) is used, this usually requires solid pieces less than 2½ to 3 inches in diameter. No combustion air regulation is required. The combustion products rise from the burning fuel and pass upward through the riser flue which directs them against the underside of heat shell cover 42 and against water heating plate 107, if used. The combustion gases then pass downwardly around the sides of the firebox and into exhaust plenum 86 beneath the fire chamber before exiting through exhaust port 84. From here, the flue gases are discharged through standard flue pipes or chimney flues. Damper 94 is open during firing.

Varying heat needs are accommodated by the length of the firing procedure. In other words, the firing period may consist of two or more consecutive burns where the fire chamber is fueled and after burner down is immediately refueled one or more times before being allowed to burn down completely. Such consecutive "burns" may be needed for a relatively large house, particularly on very cold days, whereas one or two burns may be sufficient for a smaller house. After the final refueling, the fire is allowed to burn until only a few glowing coals remain. At this stage, damper 94 in exhaust pipe 92 is closed to prevent heat loss by the passage of outside air through the fire chamber and related flues. The trapped heat is then slowly released through the heat shell by radiation and convection from its exterior surfaces over relatively long periods of time. Exterior surfaces of the heat shell may reach temperatures as high as about 180° F. to 200° F. which is an effective temperature to warm an adjacent room or air passed over these surfaces but not so hot as will burn the skin if accidentally touched. For a large home or in extremely cold weather, a second firing period in the evening may be necessary to keep the house warm through the night. In many houses, one firing period of one or two burn duration per day may be sufficient to keep the house confortably warm through late fall and from late winter on through spring. Only during the bitter cold of January and February may regular twice a day firing periods be necessary. Similarly, the heating needs of a large house might call for more than two firing periods and two, three or more burns during each firing.

When initiating firing in a completely cold system, it is advisable to begin with a light burn initially, for example with a half-fueled firebox. Fully stoked burns would then follow this light warm-up burn. If a high intensity fire is started initially in a cold system, thermal stresses may prove damaging to individual masonry modules. However, when the system is being consistently fired during the heating season so that the masonry temperature is kept above 50° F., preferably 60° F., each firing period may begin with a fully stoked burn.

Omission tests performed on a prototype unit show that when the system is fired with wood, there is no measurable carbon monoxide as is associated with incomplete fuel combustion. The tests indicated that a typical exhaust combustion gas may have the following composition by volume:

TABLE I

| | |
|---|---|
| Nitrogen (N) | 79.00% |
| Oxygen (O) | 14.00% |
| Carbon dioxide ($CO_2$) | 5.95% |
| Argon (A) | 0.92% |
| Water vapor ($H_2O$) | 0.16% |
| Carbon monoxide (CO) | 0.00% |

The prototype system was operated on softwood fuel for about two months prior to the above tests and at the time of the tests, the exhaust duct work was inspected and found to be free of creosote. These tests demonstrate that the masonry heating system of the invention burns solid fuels such as wood and coal to a high degree of completion. Because it burns solid fuels so completely, pitch-filled softwoods, such as pine and other conifers, comprise satisfactory sources of fuel for this system. Conventional woodburning devices often avoid using conifers as a fuel because burning them results in excessive creosote buildup in internal and external flues.

In operating the present system, the stack temperature in exhaust pipe 92 leading from the rear of the heat shell should reach a temperature during firing of at least about 175° F. and preferably in the range of 175° F. to 350° F. Temperatures in excess of 350° F. indicate that combustion heat is being produced faster than the masonry heat sink can absorb it. Since this unabsorbed heat is simply lost out of the stack and wastes fuel, over firing of the system should be avoided so that exhaust temperatures remain less than about 350° F.

INDUSTRIAL APPLICABILITY

The invention has a wide range of residential and commercial uses. For example, the masonry heating system may serve as a radiant and natural convention space heater for adjacent spaces in direct communication with at least some portion of the heat shell. For spaces in communication with the fuel opening into the firebox, the system may also serve as a fireplace for providing direct radiant heat from flames contained within the fire chamber.

The masonry system may also serve as a source of heat for natural convection or forced water or air systems for conveying heat to remote spaces or to industrial processes. For example, the system may serve as a source of heat for potable hot water or for preheating cold tap water before it is fed to a conventional hot water heater. The system may also serve as a supplemental heat source for a conventional hot air ducting system already in place in a house or other building.

The individual modules of the masonry heating system may be rapidly assembled and promptly put into operation as a masonry heating system of the various types described. Furthermore, the system may utilize almost any commercially available solid, liquid or gaseous fuel in order to generate combustion heat which can then be stored for long periods of time in the relatively large mass of masonry material provided by the heat shell of the system.

What is claimed is:

1. A modular masonry heating system for providing heat to a space comprising:

a plurality of heat shell modules each having a substantially uniform size and shape precast from refractory material and having means for engaging an adjoining heat shell module so as to form a self-supporting heat shell without said adjoining heat shell modules being secured together by a bonding material, said heat shell comprising an enclosing wall supported on a supporting surface and a cover supported on said enclosing wall to form a flue chamber;

a firebox supported within said flue chamber independently of said heat shell and in spaced relation to at least a portion of said heat shell, said firebox including an enclosure forming a fire chamber for burning a combustible fuel, foundation means for supporting said fire chamber enclosure on said supporting surface and riser means for conveying products of combustion from said fire chamber to said flue chamber so as to heat an exterior surface of said heat shell, said firebox and said heat shell each being freestanding independently of the other;

means for introducing a combustible fuel and combustion air into said fire chamber; and, means for exhausting said combustion products from said flue chamber;

each of said wall modules having an elongated body of substantially rectangular cross-section and joint means at each end of said elongated body for forming a joint with another of said wall modules when two of said wall modules are in abutting relation such that said joint has substantially the same rectangular cross-section as said elongated body, and said joint means comprising a tongue projecting from each end of said elongated body and arranged to rest on a corresponding tongue of another of said wall modules when two of said wall modules are in either longitudinal or perpendicular end-to-end abutment with one module inverted relative to the other.

2. The modular system of claim 1 in which said heat shell cover comprises a plurality of cover modules having a sub-substantially uniform shape different from the shape of said wall modules.

3. The modular system of claim 1 in which said firebox comprises a plurality of precast refractory modules each having means for engaging an adjoining firebox module so that said firebox is self-supporting without said adjoining firebox modules being secured together by a bonding material, the shape of said firebox modules being substantially different from the shape of said heat shell modules.

4. The modular system of claim 3 in which said firebox modules and said heat shell modules each weigh less than about 175 pounds and more than about 30 pounds.

5. The modular system of claim 3 in which said firebox foundation means forms an ashpit beneath at least a portion of said fire chamber enclosure, said firebox further includes means for discharging ashes from said fire chamber enclosure to said ashpit, and said modular system further includes means for removing ashes from said ashpit.

6. The modular system of claim 5 in which said firebox foundation means comprises a plurality of modules having a substantially uniform size and shape.

7. The modular system of claim 3 in which said exhaust means includes an exhaust port formed in said heat shell wall below the level of said fire chamber enclosure, and said firebox foundation means includes modular components abutting said heat shell wall adjacent to said exhaust port so as to form an exhaust flue for causing combustion products to pass under at least a portion of said fire chamber before being discharged from said heat shell.

8. The modular system of claim 3 in which said fuel introducing means includes an opening in said heat shell wall for providing access to said fire chamber, and in which said fire chamber enclosure comprises a bottom module, a rear wall module and opposing sidewall modules, said bottom and sidewall modules abutting said heat shell wall adjacent to said access opening such that a portion of said heat shell wall forms a front wall of said fire chamber enclosure.

9. A modular masonry heating system for providing heat to a space comprising:

a plurality of heat shell modules each having a substantially uniform size and shape precast from refractory material and having means for engaging an adjoining heat shell module so as to form a self-supporting heat shell without said adjoining heat shell modules being secured together by a bonding material, said heat shell comprising an enclosing wall supported on a supporting surface and a cover supported on said enclosing wall to form a flue chamber;

a firebox supported within said flue chamber independently of said heat shell and in spaced relation to at least a portion of said heat shell, said firebox including an enclosure forming a fire chamber for burning a combustible fuel, foundation means for supporting said fire chamber enclosure on said supporting surface and riser means for conveying products of combustion from said fire chamber to said flue chamber so as to heat an exterior surface of said heat shell, said firebox and said heat shell each being freestanding independently of the other;

means for introducing a combustible fuel and combustion air into said fire chamber;

means for exhausting said combustion products from said flue chamber; and, plenum means surrounding at least a portion of said heat shell so as to direct fresh air against said heated exterior surface and heat said fresh air with heat stored in said refractory heat shell modules.

10. The modular system of claim 9 in which said firebox is in spaced relation to said heat shell and said riser means includes a flue for directing said combustion products upward against said heat shell cover.

11. The modular system of claim 10 in which said heat shell wall is in spaced relation to said riser means and said exhaust means includes an exhaust port located below the top of said riser flue so as to draw said combustion products downward between said riser and said heat shell wall.

12. The modular system of claim 11 in which a major portion of said heat shell wall is in spaced relation to said firebox, said fire chamber enclosure is vertically spaced above said supporting surface, and said exhaust port is positioned below the level of the bottom of said fire chamber enclosure such that said combustion products are drawn downward past a major portion of said heat shell wall before being discharged through said exhaust port.

13. The modular system of claim 10 in which the horizontal cross-sectional area of said riser flue is substantially less than the horizontal cross-sectional area of said fire chamber.

14. The modular system of claim 10 in which said riser comprises a plurality of precast refractory modules each having a substantially uniform annular shape such that when said riser modules are stacked in edge to edge abutment the annuli of said riser modules form said riser flue.

15. The modular system of claim 9 in which a sealant material is disposed between said adjoining heat shell modules so as to prevent ambient air from passing between said adjoining heat shell modules and into said flue chamber.

16. The modular system of claim 9 in which said plenum means comprises modular sheets of masonry material.

17. The modular system of claim 9 which further comprises air supply means for supplying cool fresh air to said plenum and air distribution means for conveying heated fresh air from said plenum to a space remote from said heat shell.

18. The modular system of claim 9 in which at least a portion of the heated exterior surface of said heat shell extends into a room in a building so as to provide both radiant and convection heat in said room.

19. The modular system of claim 9 in which said fuel and air introducing means includes means for introducing wood, oil, gas or a combination of said combustible fuels into said fire chamber.

20. A masonry heating system according to claim 9 made from a kit of precast refractory modules, said kit comprising:

a plurality of wall modules of substantially uniform size and shape each having means for engaging an adjoining wall module so as to form a self-supporting enclosing wall;

a plurality of cover modules of substantially uniform size and shape each having means for engaging an adjoining cover module so as to form a self-supporting cover, said enclosing wall being supportable on a substantially flat surface and said cover being supportable on said enclosing wall to form a heat shell having a flue chamber;

a plurality of fire chamber modules each having means for engaging an adjoining fire chamber module so as to form a self-supporting enclosure having a fire chamber for burning a combustible fuel; and, a plurality of riser modules of substantially uniform size and shape each having means for engaging an adjoining riser module so as to form a self-supporting riser having a flue for directing products of combustion from said fire chamber against said heat shell, said fire chamber enclosure being supportable on said substantially flat surface and said riser being supportable on said fire chamber enclosure to form a firebox within said flue chamber in spaced relation to at least a portion of said heat shell;

said firebox and said heat shell being freestanding independently of the other and each being self-supporting without said modules being secured together by a bonding material.

21. The kit of claim 20 in which the spaced relation between said firebox and said heat shell is such that an exhaust port communicating with said flue chamber below the level of said fire chamber enclosure will draw said combustion products downward between said firebox and said heat shell wall before exhausting said combustion products from said flue chamber.

22. The kit of claim 21 in which said exhaust port is preformed in at least one of said wall modules.

23. The kit of claim 20 in which a port for providing fresh air to said fire chamber is preformed in at least one of said wall modules.

24. The kit of claim 20 which further includes a plurality of foundation modules each having means to engage at least one of said fire chamber modules so as to support said fire chambe enclosure above said substantially flat surface and form an ash pit beneath at least a portion of said fire chamber enclosure.

25. A kit of claim 20 in which a port for removing ashes from said ash pit is preformed in at least one of said wall modules.

* * * * *